US012357893B2

(12) United States Patent
Chisholm

(10) Patent No.: US 12,357,893 B2
(45) Date of Patent: Jul. 15, 2025

(54) DYNAMIC ROWING MACHINE

(71) Applicant: Brian J. Chisholm, Evanston, IL (US)

(72) Inventor: Brian J. Chisholm, Evanston, IL (US)

( * ) Notice: Subject to any disclaimer, the term of this patent is extended or adjusted under 35 U.S.C. 154(b) by 145 days.

(21) Appl. No.: 18/554,717

(22) PCT Filed: Apr. 21, 2022

(86) PCT No.: PCT/US2022/025722
§ 371 (c)(1),
(2) Date: Oct. 10, 2023

(87) PCT Pub. No.: WO2022/231936
PCT Pub. Date: Nov. 3, 2022

(65) Prior Publication Data

US 2024/0115920 A1 Apr. 11, 2024

Related U.S. Application Data

(60) Provisional application No. 63/179,569, filed on Apr. 26, 2021.

(51) Int. Cl.
*A63B 69/06* (2006.01)
*A63B 21/00* (2006.01)
(Continued)

(52) U.S. Cl.
CPC ..... *A63B 69/06* (2013.01); *A63B 21/0052* (2013.01); *A63B 21/225* (2013.01);
(Continued)

(58) Field of Classification Search
CPC ..... A63B 21/0052; A63B 21/225; A63B 21/4029; A63B 21/4031; A63B 21/4034;
(Continued)

(56) References Cited

U.S. PATENT DOCUMENTS 355,266 A * 12/1886 Heibecker ..... A63B 22/0076 482/72
2,183,345 A * 12/1939 Brandon ..... A63B 22/0076 482/95

(Continued)

OTHER PUBLICATIONS

Written Opinion of the International Searching Authority dated Jul. 19, 2022.

*Primary Examiner* — Gary D Urbiel Goldner
(74) *Attorney, Agent, or Firm* — Jacob M. Ward; Ward Law Office LLC

(57) ABSTRACT

A dynamic rowing machine configured to simulate a motion of a rower working through a rowing motion of a rowing scull is provided. The dynamic rowing machine includes a stationary framework having one or more lifting profiles. Each of the lifting profiles has one or more segments forming a rising path and one or more segments forming a horizontally rearward path. The one or more segments forming the rising path and the one or more segments forming the horizontally rearward path form a continuous path. A dynamic framework is supported for movement along the continuous paths of the one or more lifting profiles of the stationary framework. Movement of the dynamic framework along the continuous paths of the one or more lifting profiles of the stationary framework results in upward and rearward movement of the dynamic framework.

20 Claims, 7 Drawing Sheets

(51) Int. Cl.
*A63B 21/005* (2006.01)
*A63B 21/22* (2006.01)
*A63B 22/00* (2006.01)

(52) U.S. Cl.
CPC ..... *A63B 21/4034* (2015.10); *A63B 22/0076* (2013.01); *A63B 2069/062* (2013.01); *A63B 2225/09* (2013.01)

(58) Field of Classification Search
CPC ..... A63B 21/4045; A63B 22/0076; A63B 22/201; A63B 22/203; A63B 2022/0079; A63B 2022/206; A63B 69/06; A63B 2069/062; A63B 2225/09
See application file for complete search history.

(56) References Cited

U.S. PATENT DOCUMENTS 2,924,456 A 2/1960 Miller
3,446,503 A * 5/1969 Lawton ..... A63B 21/4047 482/96
3,912,264 A * 10/1975 Busse ..... A63B 22/0076 73/379.06
5,072,929 A 12/1991 Peterson et al.
5,342,269 A * 8/1994 Huang ..... A63B 22/0076 482/130
5,507,709 A * 4/1996 Wu ..... A63B 21/4047 482/96
5,512,027 A * 4/1996 Chen ..... A63B 22/0076 482/130
5,582,563 A * 12/1996 Fan ..... A63B 22/0076 482/96
5,827,158 A * 10/1998 Drecksel ..... A63B 22/0076 482/96
6,196,954 B1 * 3/2001 Chen ..... A63B 22/203 D21/676
7,232,404 B2 6/2007 Nelson
7,361,124 B1 4/2008 Chung-Ting
8,043,195 B2 * 10/2011 Cunningham ..... A63B 23/0423 482/56
11,413,494 B1 * 8/2022 Habing ..... A63B 21/225
2011/0028278 A1 2/2011 Roach
2014/0243163 A1 * 8/2014 Edmondson ..... A63B 21/227 482/72
2015/0031478 A1 * 1/2015 Alden-Dunn ..... A63B 21/015 473/446
2019/0299052 A1 * 10/2019 St.Cyr ..... A63B 21/22
2020/0023232 A1 1/2020 French et al.

* cited by examiner

DYNAMIC ROWING MACHINE

RELATED APPLICATIONS

This application claims the benefit of pending PCT Patent Application Serial No. PCT/US22/25722, filed Apr. 21, 2022, which claimed the benefit of U.S. Provisional Patent Application Ser. No. 63/179,569 filed Apr. 26, 2021, the disclosures of which are incorporated herein by reference in their entireties.

BACKGROUND

Conventional rowing machines are designed to allow a user to loosely mimic the rowing motion of a scull, and thereby providing physical exercise for the rower. Exercise rowers generally form two natural groups; people just looking for some exercise and others who actually row in racing sculls and need to train.

Conventional rowing machines are known in a wide variety of mechanical apparatus. Conventional rowing machines typically include a rolling seat on one or more rails, footrests, and a handle connected to engage a means of resistance. In operation, the rower places their feet in the footrests, grabs the handle, and with proper motion extends their legs while pulling the handle toward their chest in a sequential motion; leg extension, then the pulling motion and recovery.

Conventional rowing machines typically limit the movement of the seat and the rower to axial movement along the one or more rails, with the machine itself remaining stationary. In this arrangement, only the rower and the seat are moving in a back & forth motion. While this may be effective to provide exercise, the design is not very true to the dynamic motion of the rower operating a scull in the water.

It would be advantageous if rowing machines could be improved to provide a more realistic and dynamic motion of the rower and the scull.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the dynamic rowing machine.

The above objects as well as other objects not specifically enumerated are achieved by a dynamic rowing machine configured to simulate the motion of a rower working through the rowing motion of a rowing scull. The dynamic rowing machine includes a stationary framework having one or more lifting profiles. Each of the lifting profiles has one or more segments forming a rising path and one or more segments forming a horizontally rearward path. The one or more segments forming a rising path and the one or more segments forming horizontally rearward path form a continuous path. A dynamic framework is supported for movement along the continuous paths of the one or more lifting profiles of the stationary framework. Movement of the dynamic framework along the continuous paths of the one or more lifting profiles of the stationary framework results in upward and rearward movement of the dynamic framework.

The above objects as well as other objects not specifically enumerated are also achieved by a method of forming a dynamic rowing machine configured to simulate the motion of a rower working through the rowing motion of a rowing scull. The method includes the steps of incorporating one or more lifting profiles into a stationary framework, each of the lifting profiles having one or more segments forming a rising path and one or more segments forming a horizontally rearward path, the one or more segments forming a rising path and the one or more segments forming horizontally rearward path forming a continuous path and supporting a dynamic framework for movement along the continuous paths of the one or more lifting profiles of the stationary framework. Wherein movement of the dynamic framework along the continuous paths of the one or more lifting profiles of the stationary framework results in upward and rearward movement of the dynamic framework.

Various objects and advantages of the dynamic rowing machine will become apparent to those skilled in the art from the following Detailed Description, when read in light of the accompanying drawings.

DETAILED DESCRIPTION

The dynamic rowing machine will now be described with occasional reference to specific embodiments. The dynamic rowing machine may, however, be embodied in different forms and should not be construed as limited to the embodiments set forth herein. Rather, these embodiments are provided so that this disclosure will be thorough and complete, and will fully convey the scope of the dynamic rowing machine to those skilled in the art.

Unless otherwise defined, all technical and scientific terms used herein have the same meaning as commonly understood by one of ordinary skill in the art to which the dynamic rowing machine belongs. The terminology used in the description of the dynamic rowing machine herein is for describing particular embodiments only and is not intended to be limiting of the dynamic rowing machine. As used in the description of the dynamic rowing machine and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the dynamic rowing machine. Notwithstanding that the numerical ranges and parameters setting forth the broad scope of the dynamic rowing machine are approximations, the numerical values set forth in the specific examples are reported as precisely as possible. Any numerical values, however, inherently contain certain errors necessarily resulting from error found in their respective measurements.

A novel dynamic rowing machine is disclosed. Generally, the dynamic rowing machine embodies the motion of a rower operating a scull in the water. That motion includes the rower and the scull simultaneously moving both in a horizontal and vertical direction with every stroke. During the extension of the rower and the seat, not only is the seat translating in a backward direction, so is the rowing scull. Additionally, as the rower initiates the "catch", that is when the oar enters the water, the boat lifts slightly as the force is generated against the water and the oar. In the novel dynamic rowing machine, the rowing motion of the rower and the implied rowing scull (rowing machine) is embodied.

Figure 1:
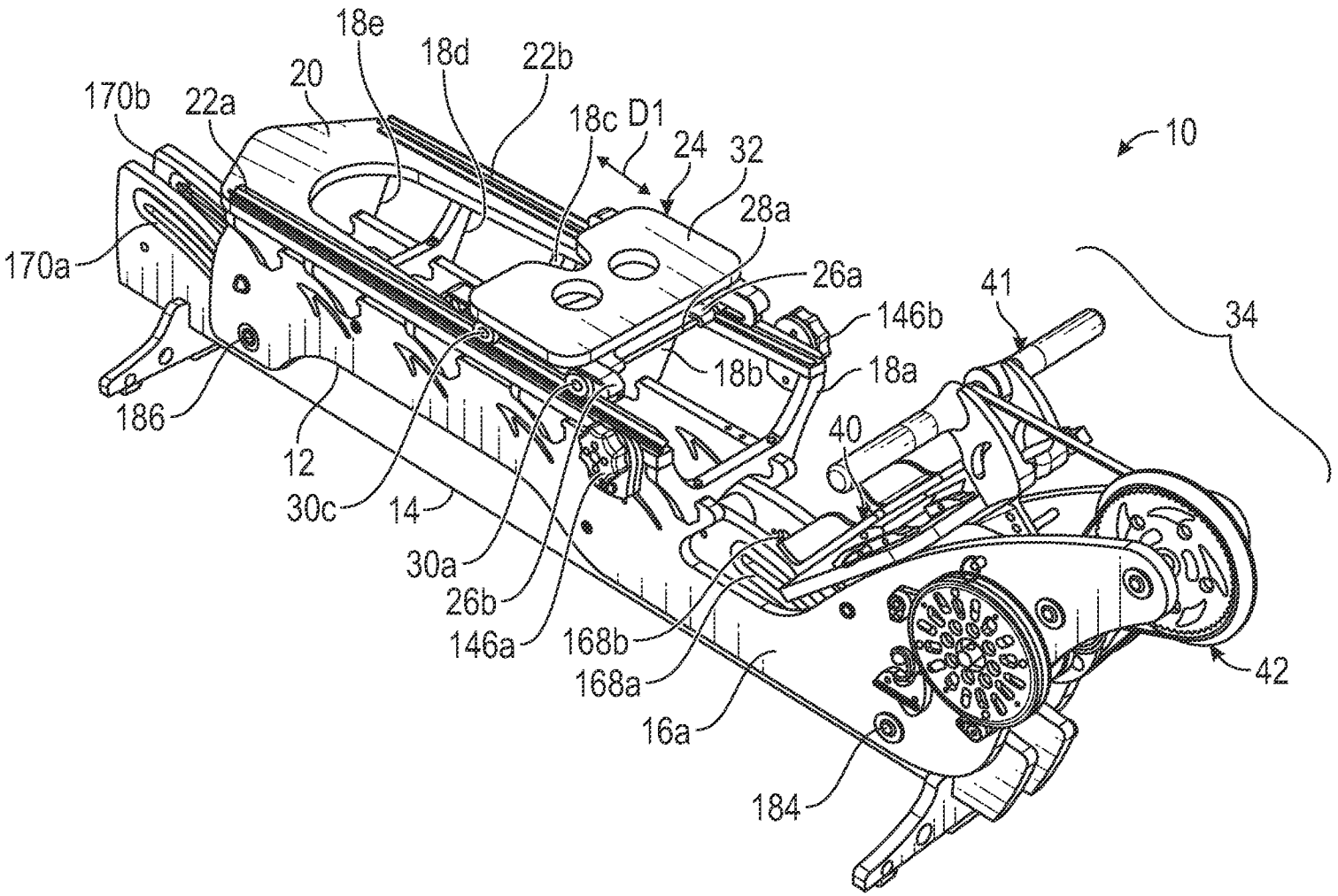
FIG. 1 is a side perspective view of a dynamic rowing machine in accordance with the invention, shown in a first or resting orientation.
Figure 2:
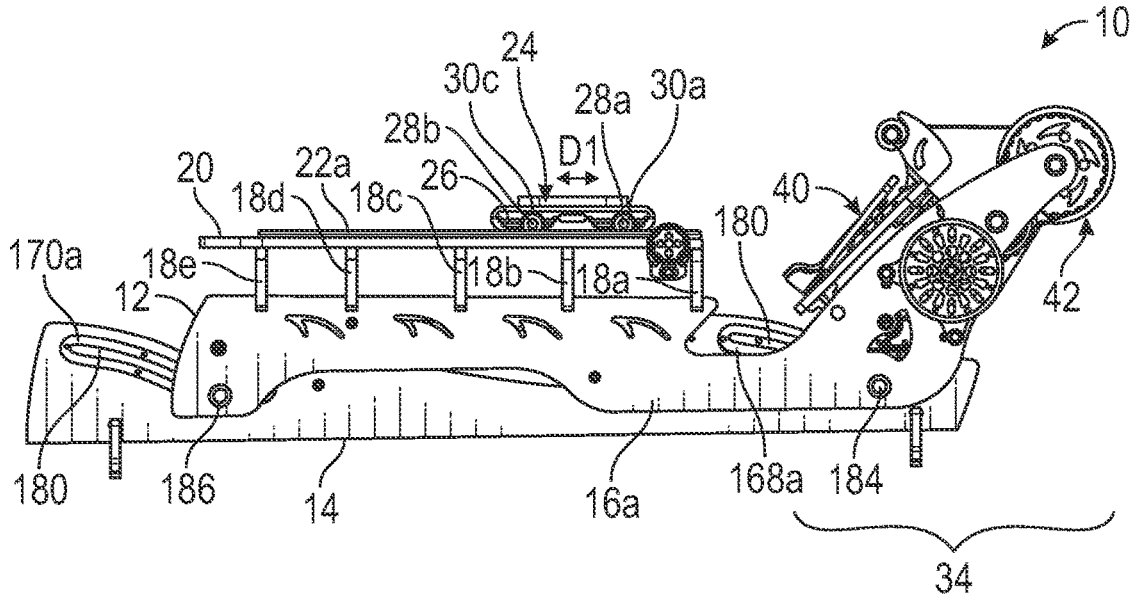
FIG. 2 is a side view of a dynamic rowing machine of FIG. 1.
Figure 3:
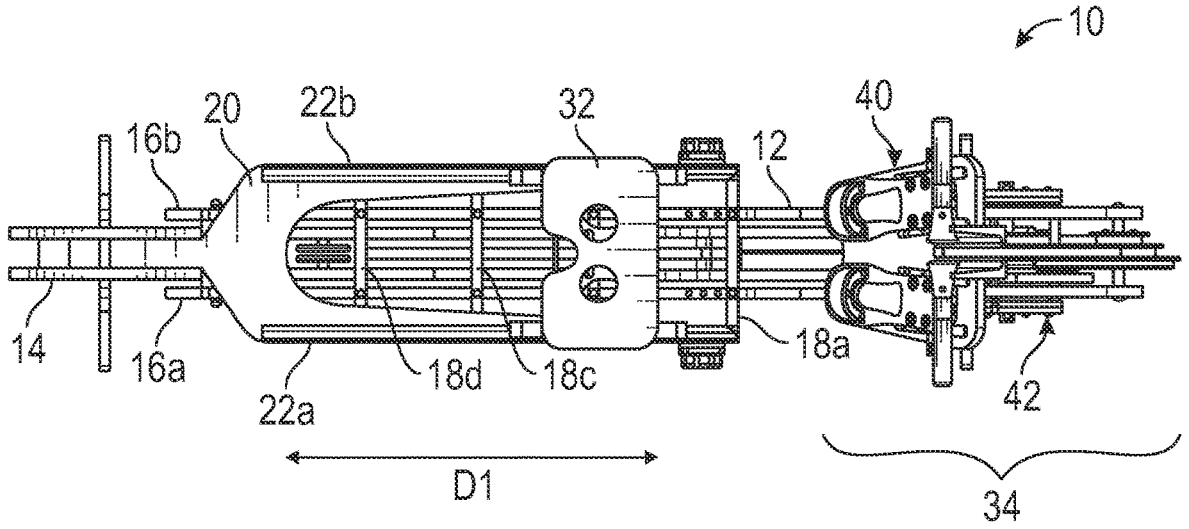
FIG. 3 is a plan view of a dynamic rowing machine of FIG. 1.

Referring now to FIGS. 1-3, the novel dynamic rowing machine is illustrated generally at 10 in an initial, or resting, orientation. The dynamic rowing machine 10 employs a double framework design that includes a dynamic framework 12 and a stationary framework 14. The term "dynamic framework", as used herein, is defined to mean a framework capable of changing orientation relative to the stationary framework 14.

Referring again to FIGS. 1-3, the dynamic framework 12 includes spaced apart dynamic rail elements 16*a*, 16*b*. The dynamic rail elements 16*a*, 16*b* are configured to support and connect to spaced apart seat supports 18*a*-18*e*. The spaced apart seat supports are configured to provide structural support to the dynamic framework 12 and are further configured to support the seat rail frame 20. While the embodiment shown in FIGS. 1-5 illustrates a quantity of five (5) seat rail frame supports 18*a*-18*e*, in other embodiments more or less than five (5) seat rail frame supports 18*a*-18*e* can be used. Opposing, spaced apart seat rails 22*a*, 22*b* are positioned on the seat rail frame 20. In the embodiment illustrated in FIGS. 1-3, the spaced apart seat rails 22*a*, 22*b* have a parallel orientation. However, in other embodiments, the spaced apart seat rails 22*a*, 22*b* can have other desired orientations.

Referring again to FIGS. 1-3, a seat assembly 24 includes spaced apart seat glides 26*a*, 26*b* configured to support first and second spaced apart seat axles 28*a*, 28*b*. First seat axle 28*a* is configured to support spaced apart first axle wheels 30*a*, 30*b* and second seat axle 28*b* is configured to support spaced apart second axle wheels 30*c*, 30*d* (axle wheels 30*b* and 30*d* are not shown for purposes of clarity). In operation, the axle wheels 30*a*, 30*c* engage seat rail 22*a* for axial movement along the seat rail 22*a* and axle wheels 30*b*, 30*d* engage seat rail 22*b* for axial movement along the seat rail 22*b*. A seat 32 is connected to the spaced apart seat glides 26*a*, 26*b* and is configured for axial movement as the axle wheels 30*a*-30*d* axially move along the seat rails 22*a*, 22*b*, as indicated by direction arrow D1.

Referring again to FIGS. 1-3, the dynamic framework 12 includes a forward section 34. The forward section 34 is configured for several functions. First, the forward section 34 is configured to support a footrest assembly 40. The forward section 34 is further configured to support a pulley assembly 42, a brake assembly 43 and a handle support assembly 41.

Figure 4:
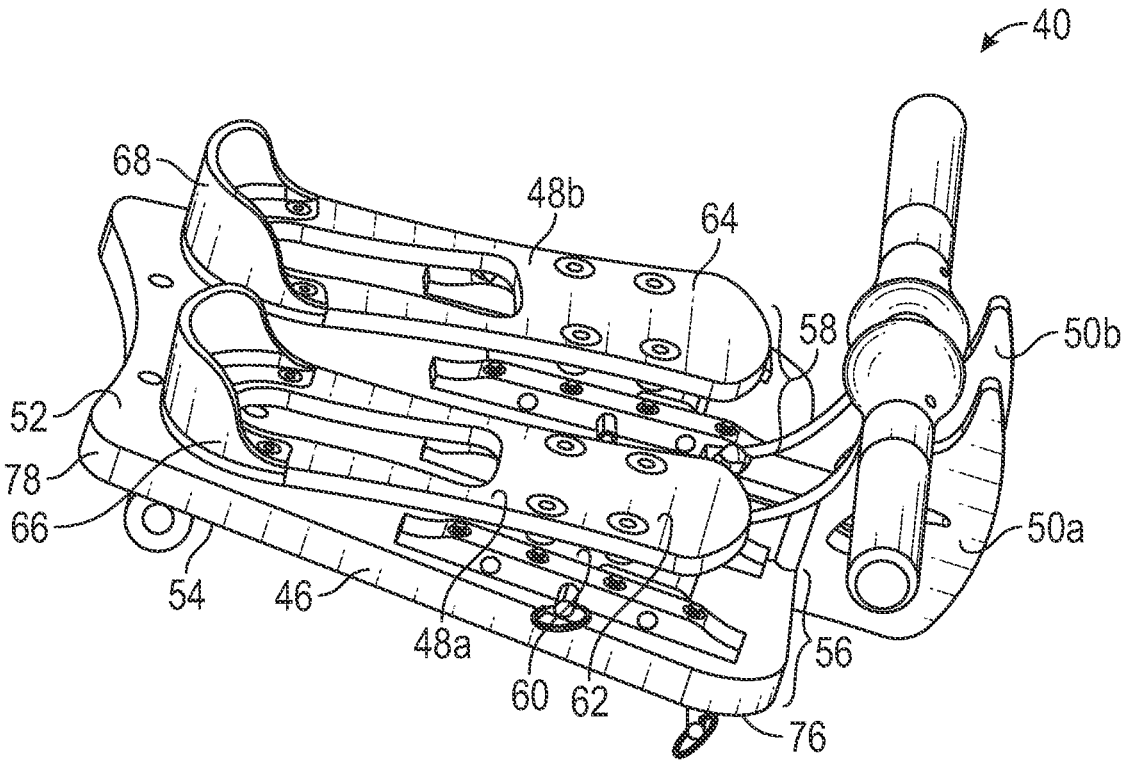
FIG. 4 is a first perspective view of a footrest assembly of the dynamic rowing machine of FIG. 1.
Figure 5:
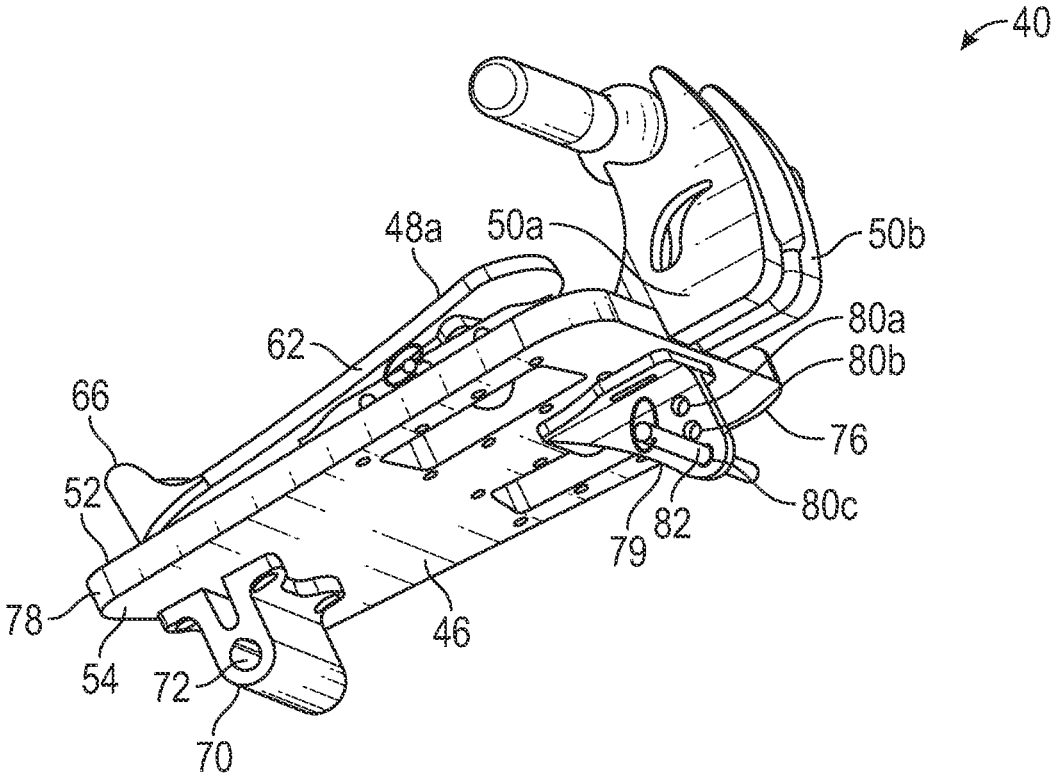
FIG. 5 is a second perspective view of a footrest assembly of the dynamic rowing machine of FIG. 1.

Referring now to FIGS. 4 and 5, the footrest assembly 40 is illustrated. The footrest assembly 40 is configured to receive the feet of a user of the dynamic rowing machine 10 during operation. The footrest assembly 40 includes a footrest framework 46, a first and second footrest 56, 58 (FIG. 5 is limited to showing the first footrest 56 for purposes of clarity) and one or more handle supports 50*a*, 50*b*. The footrest assembly 46 is centered about a longitudinal axis A-A.

Referring again to FIGS. 4 and 5, the footrest framework 46 has an upper major surface 52 and a lower major surface 54. The upper major surface 52 is configured to support the first and second footrests 56, 58 for movement. The first footrest 56 is centered about a longitudinal axis B-B and the second footrest 58 is centered about a longitudinal axis C-C. In the embodiment illustrated in FIG. 4, the axes A-A, B-B and C-C have a parallel orientation to each other. However, in other embodiments, the axes A-A, B-B and C-C can have other relative orientations.

Referring again to FIGS. 4 and 5, the first footrest 56 is connected to footrest extension element 60 having an aperture 61. The footrest extension element 60 is configured for guidance by and within spaced apart position elements 62*a*, 62*b*. The position elements 62*a*, 62*b* have a parallel orientation and each of the position elements 62*a*, 62*b* includes a plurality of spaced apart apertures 63.

Referring again to FIGS. 4 and 5, in operation the position of each of the first and second footrests 56, 58 is adjustable as the first and second footrests 56, 58 move in an axial direction along their respective axes B-B and C-C. Once positioned in an appropriate position, each of the first and second footrests 56, 58 is retained in position with a retention pin 64, inserted into aligned apertures 63 of the position elements 62*a*, 62*b* and the aperture 61 of the footrest extension element 60. In the illustrated embodiment, the retention pin 64 has the form of a quick release, spring-loaded ball pin. However, in other embodiments, the retention pin 64 can have other forms sufficient to retain the relative position of the footrests 56, 58 and the footrest framework 46. In this manner, first and second footrests 56, 58 can advantageously be positioned to accommodate differing leg lengths. While the first and second footrests 56, 58 have been described above as incorporating certain components, elements and structures, it is contemplated that in other embodiments, the first and second footrests 56, 58 can incorporate other components, elements and structures sufficient to accommodate differing leg lengths.

Referring now to FIG. 5, a pivot bracket 70 is attached to the lower major surface 54 of the footrest framework 46. The pivot bracket 70 includes an aperture 72 extending therethrough. The aperture 72 is configured to receive a shaft (not shown for purposes of clarity) that extends from the dynamic rail element 16*a* to the opposing dynamic rail element 16*b*, thereby facilitating rotation of a first end 76 of the footrest assembly 40 about a second end 78 of the footrest assembly 40. Rotation of the first 76 of the footrest assembly 40 results in the footrest assembly 40 assuming differing orientation angles, thereby advantageously allowing a user to select differing foot and ankle angles.

Referring again to FIG. 5, an attachment bracket 79 is connected to the lower major surface 54 of the footrest framework 46 at the first end 76. The attachment bracket 79 includes a plurality of apertures 80*a*-80*c* arranged in a substantially vertical pattern. Each of the apertures 80*a*-80*c* is configured to receive an adjusting pin 82 that extends from the dynamic rail element 16*a* to the opposing dynamic rail element 16*b*, thereby fixing the orientation angle of the footrest assembly 40.

Referring again to the embodiment shown in FIGS. 4 and 5, while the footrest assembly 40 is described above as incorporating the pivot bracket 70, the attachment bracket 79 and the adjusting pin 82, in alternate embodiments, the orientation angle of the footrest assembly 40 can be adjusted and fixed in place with other structures, mechanisms and devices.

Figure 6:
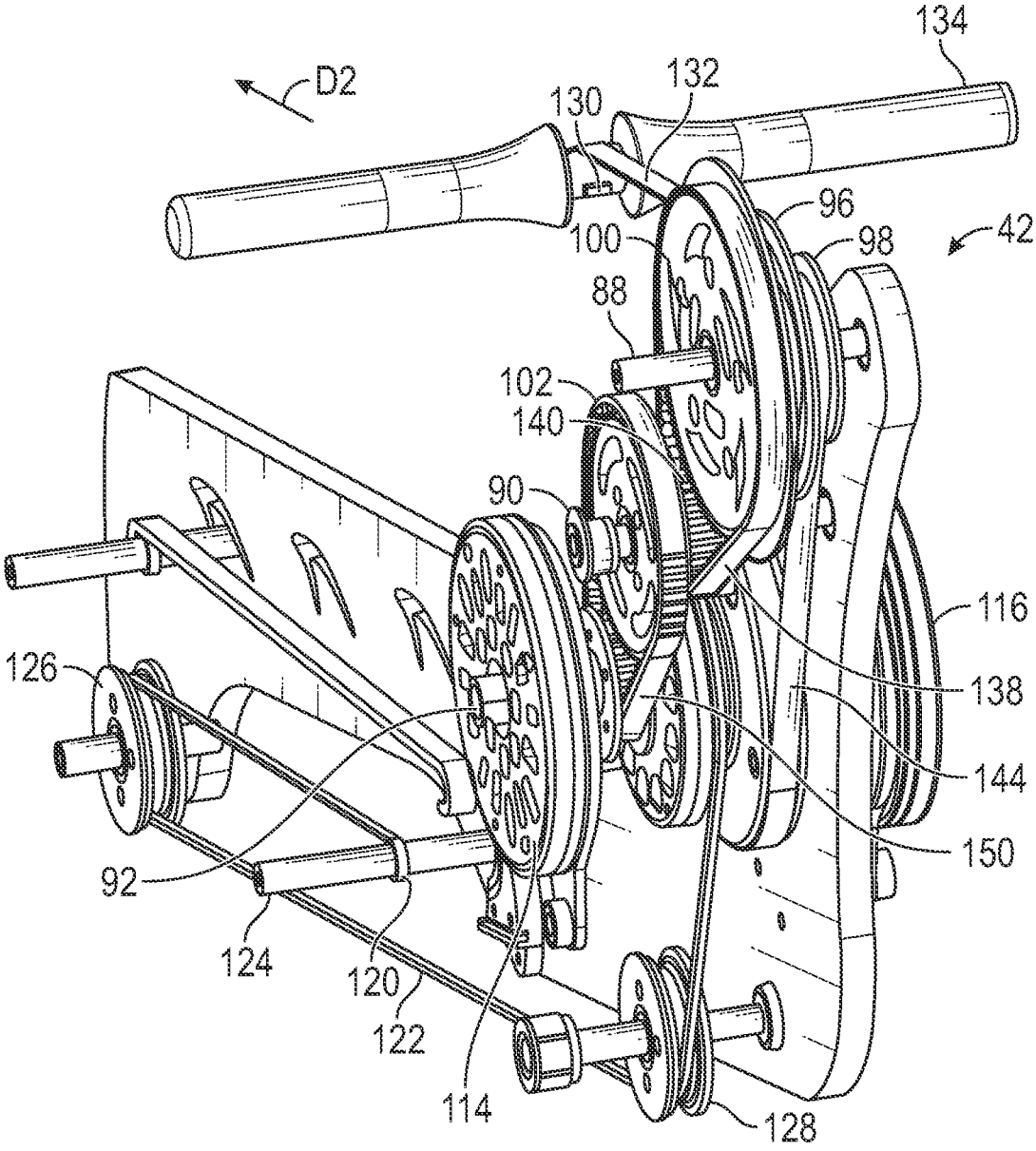
FIG. 6 is a perspective view of a pulley assembly of the dynamic rowing machine of FIG. 1.
Figure 7:
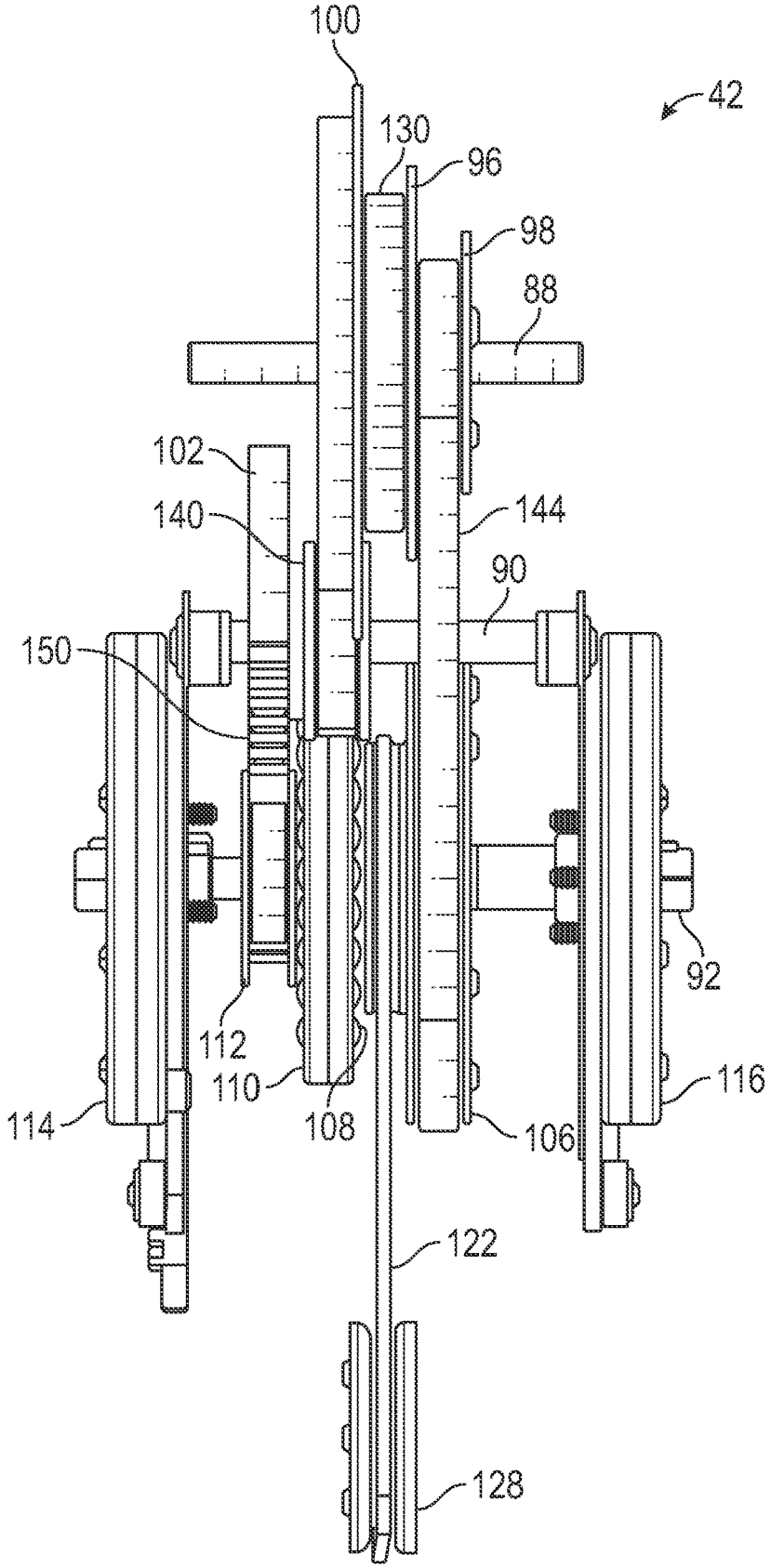
FIG. 7 is a front view of a pulley assembly and brake of the dynamic rowing machine of FIG. 1.

Referring now to FIGS. 6 and 7, the pulley assembly 42 and brake assembly 43 are illustrated. The pulley assembly 42, in combination with the brake assembly 43, is configured to provide a variable resistance to the user. The brake assembly 43 is configured to slow rotation of portions of the pulley assembly 42 and will be discussed in more detail below. The pulley system 42 includes a first shaft 88, a second shaft 90, a third shaft 92. The first shaft 88 supports a primary pulley 96, a secondary pulley 98 and an eddy brake pulley 100 for rotation. The second shaft 90 supports a tertiary eddy brake pulley 102 for rotation. The third shaft 92 supports a drive pulley 106, a cable pulley 108, a flywheel 110, a one-way clutch 112, a first eddy brake assembly 114 and a second eddy brake assembly 116. The term "eddy brake assembly" 114, 116 as used herein, is defined to mean any structure, device or mechanism configured to slow or stop a moving object by dissipating its kinetic energy as heat by employing an electromagnetic force between a magnet and a nearby conductive object in relative motion.

Referring again to FIGS. 6 and 7, a first end 120 of a rower cable 122 is connected to the dynamic framework 12 by way of a framework shaft 124. The rower cable 122 extends around a first idler pulley 126 that is affixed to the stationary framework 14. The rower cable 122 then extends around a second idler pulley 128 and a second end of the rower cable 122 terminates with the cable pulley 108.

Referring again to FIGS. 6 and 7, a first end 130 of a handle strap 132 is connected to a handle 134. The handle strap 132 extends from the handle 134 and wraps, with several turns, around the primary pulley 96. A primary belt 138 engages the eddy brake pulley 100 and a drive sprocket 140 supported by the second shaft 90. A drive strap 144 engages the secondary pulley 98 and the drive pulley 106. Finally, an eddy brake belt 150 engages the tertiary eddy brake pulley 102 and the one-way clutch 112.

Referring now to FIGS. 1 and 6, in operation a user seated on the seat assembly 24 and with the user's feet seated in the adjustable footrests 56, 58, pulls the handle 134 in a rearward direction as depicted by direction arrow D2. Movement of the handle 134 in a rearward direction results in a counterclockwise rotation of the primary pulley 96, the adjoining secondary pulley 98 and eddy brake pulley 100. Counterclockwise rotation of the secondary pulley 98 results in counterclockwise rotation of the drive strap 144, thereby resulting in counterclockwise rotation of the drive pulley 106. Counterclockwise rotation of the eddy brake pulley 100 results in counterclockwise rotation of the primary belt 138, thereby resulting in counterclockwise rotation of the drive sprocket 140 and tertiary eddy brake pulley 102.

Referring again to FIGS. 1 and 6, rotation of the tertiary eddy brake pulley 102, eddy brake belt 150 and one-way clutch 112 results in counterclockwise rotation of the third shaft 92, thereby resulting in counterclockwise rotation of the flywheel 110. Counterclockwise rotation of the flywheel 110 is used to provide initial and steady resistance to the exercise until the eddy brake assemblies 114, 116 gain rotational speed. Counterclockwise rotation of the drive sprocket 140 results in counterclockwise rotation of the one-way clutch 112. The counterclockwise rotation of the one-way clutch 112 results in counterclockwise rotation of internal portions of the eddy brake assemblies 114, 116.

Referring now to FIGS. 6 and 7, each of the eddy brake assemblies 114, 116 is configured to provide resistance to the rowing exercise. The resistance provided by each of the eddy brake assemblies 114, 116 can be independently increased or decreased through rotatable internal mechanisms (not shown for purposes of clarity) that move magnet elements in radial directions along a conductive element, such as the non-limiting example of a metallic disc. In the illustrated embodiment, the rotatable internal mechanisms have the form of resistance plates. In alternate embodiments, the rotatable internal mechanisms can have other forms.

Referring now to FIGS. 1, 6 and 7, the resistance provided by the eddy brake assemblies 114, 116 can be user adjusted by rotation of one or more brake handles 146*a*, 146*b*. The brake handle 146*a* is in communication with the eddy brake assembly 114 via a cable and the brake handle 146*b* is in communication with the eddy brake assembly 116 via a separate cable (the cables are not shown for purposes of clarity). In operation, rotation of either or both of the brake handles 146*a*, 146*b* results in increasing or decreasing of the resistance provided by the associated eddy brake assembly 114, 116. While the illustrated embodiment employs brake handles 146*a*, 146*b* and associated cables to adjust the resistance provided by the eddy brake assemblies 114, 116, in other embodiments, other structures, mechanisms and devices can be used to adjust the resistance provided by the eddy brake assemblies 114, 116.

Referring now to the embodiment shown in FIG. 7, quantity of two eddy brake assemblies 114, 116 are provided. It should be appreciated that in other embodiments, a lone eddy brake assembly or more than two eddy brake assemblies can be provided, sufficient to provide resistance to the rowing exercise.

Referring now to FIGS. 6 and 7, in operation, the rotation of the primary pulley 96 and the resistance plates of the eddy brake assemblies 114, 116 are coupled together such that rotation of the primary pulley 96 results in a desired rotation ratio of the eddy brake resistance plates. In the illustrated embodiment, each rotation of the primary pulley results in the eddy brake resistance plates rotating 15 revolutions. However, it should be appreciated that in other embodiments, other desired ratios can be used. Still further, the eddy brake assembly 114 is configured such that the faster the rearward pull of the handle 134, the greater the resistance provided by the eddy brake assembly 114. In this manner, advantageously a user can determine the level of resistance provided during a workout simply by varying the speed in which the handle is pulled in a rearward direction.

Referring again to FIGS. 6 and 7, as the handle 134 is pulled rearward and the drive pulley 106 rotates in a counterclockwise direction, the rower cable 122 wraps around the cable pulley 108 in a manner such as to shorten the length of the rower cable 122. Since the first end 120 of the rower cable 122 is affixed to the dynamic framework 12, shortening the rower cable 122 functions to move the dynamic framework 12 in a rearward direction. The movement of the dynamic framework 12 in a rearward direction will be discussed in more detail below.

Referring again to FIGS. 6 and 7 and as discussed above, counterclockwise rotation the one-way clutch 112 is configured to produce counterclockwise rotation of the eddy brake assembly 114 and counterclockwise rotation of the eddy brake resistance plate. The one-way clutch 112 is further configured disengage the eddy brake assembly 114 during forward movement of the handle 134.

In the embodiment shown in FIGS. 6 and 7 and described above, the variable resistance provided by the pulley assembly 42 is based on a plurality of eddy brake assemblies. However, in other embodiments, variable resistance can be provided with other structures, mechanisms and devices.

Figure 8:
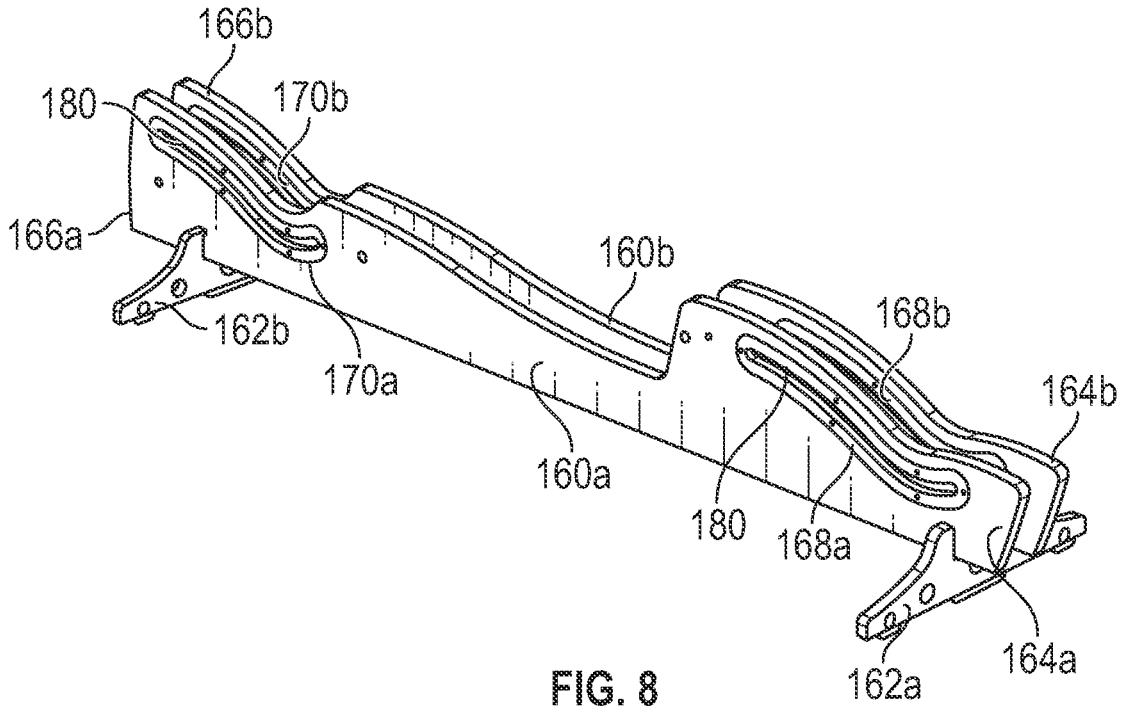
FIG. 8 is a side perspective view of a stationary framework of the dynamic rowing machine of FIG. 1.

Referring now to FIG. 8, the stationary frame 14 is illustrated. The stationary frame 14 includes opposing, spaced apart first and second frame elements 160*a*, 160*b*, each supported for substantially perpendicular orientation by spaced apart stand elements 162*a*, 162*b*. Each of the frame elements 160*a*, 160*b* has a first end 164*a*, 164*b* and an opposing second end 166*a*, 166*b*. A first lifting profile 168*a* is positioned proximate the first end 164*a* of the first frame element 160*a* and a first lifting profile 168*b* is positioned proximate the first end 164*b* of the second frame element 160*b*. A second lifting profile 170*a* is positioned proximate the second end 166*a* of the first frame element 160*a* and a second lifting profile 170*b* is positioned proximate the second end 166*b* of the second frame element 160*b*.

Figure 9:
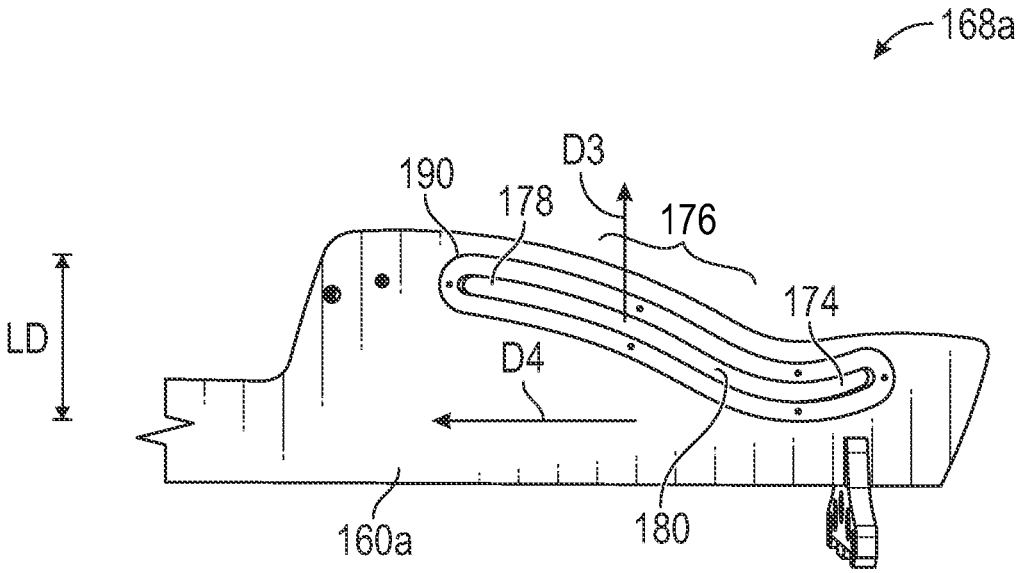
FIG. 9 is a side view of a first lifting profile of the stationary framework of FIG. 1.

Referring now to FIG. 9, the first lifting profile 168*a* illustrated. The first lifting profile 168*a* is representative of the lifting profiles 168*b*, 170*a* and 170*b*. The first lifting profile 168*a* has the form of a slot having arcuate segments. The first lifting profile 168*a* has a first end actuate segment 174, an arcuate center segment 176 and a second end arcuate segment 178. Taken together, the segments 174, 176 and 178 form a vertically rising and rearwardly directed path 180 that has a combination of upward direction, as schematically illustrated by direction arrow D3, and rearward direction, as schematically illustrated by direction arrow D4.

Referring now to FIGS. 1 and 9, the path 180 forms a track that is configured to guide a first follower axle 184 of the dynamic framework 12. As first follower axle 184 moves along the path 180, in the combination of the vertically rising D3 and rearward D4 directions simulates the motion of a rower working through the rowing motion, that is, simulating the motion of the rower and the rowing scull. The segments 174, 176 and 178 combine to produce a lift distance LD of the dynamic framework 12 and further combine to produce a rearward distance RD. In the illustrated embodiment, the distance LD is in a range of from about 2.0 inches to about 8.0 inches and the distance RD is in a range of from about 10.0 inches to about 20.0 inches. However, in other embodiments, the distance LD can be less than about 2.0 inches or more than about 8.0 inches and the distance RD can be less than about 10.0 inches or more than about 20.0 inches, sufficient to provide a combination of vertically rising and rearward directions.

Referring now to FIGS. 8 and 9, the first end arcuate segment 174, the arcuate center segment 176 and the second end arcuate segment 178 are shown with certain radii and centers of rotation. However, in other embodiments, the first end arcuate segment 174, the arcuate center segment 176 and the second end arcuate segment 178 can have different radii and different centers of rotation in order to achieve different paths 180 and associated different dynamic movements. Further, while the embodiment shown in FIG. 8 shows each of the lifting profiles 168*a*, 168*b*, 170*a*, 170*b* as forming an identical path 180, it should also be appreciated that in other embodiments, the first lifting profiles 168*a*, 168*b* can be different from the second lifting profiles 170*a*, 170*b*.

Referring now to FIGS. 1 and 2, the first lifting profiles 168*a*, 168*b* are configured to receive the follower axle 184 and the second lifting profiles 170*a*, 170*b* are configured to receive the second follower axle 186 in a manner such that the follower axles 184, 186 are guided in a rolling motion along the paths 180 defined by the first and second lifting profiles 168*a*, 168*b*, 170*a*, 170*b*. In this manner, as the rower moves through the simulated rowing motion as initiated by the rearward movement of the handle 134, a vertically rising and rearward motion is imparted to the dynamic framework 12 and the user.

Figure 10:
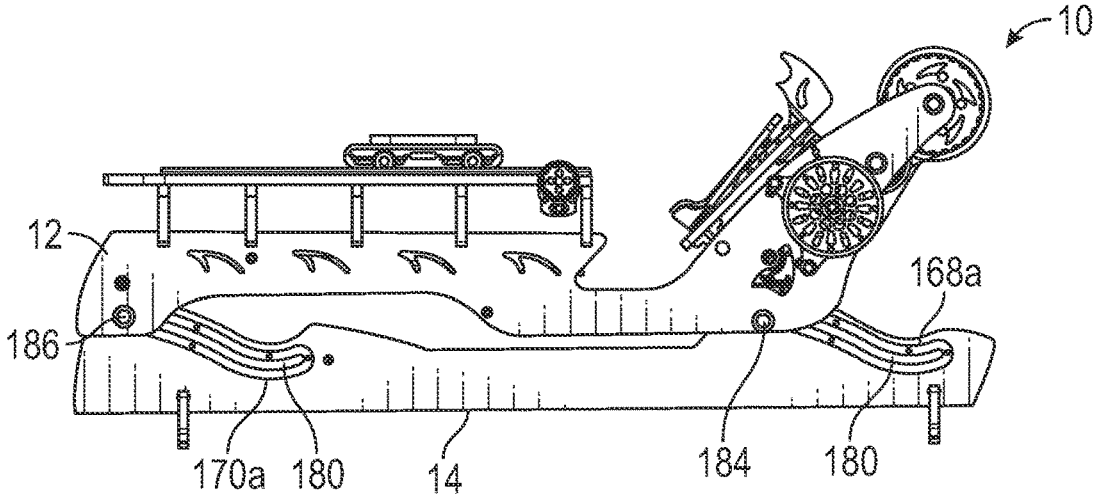
FIG. 10 is a side view of a dynamic rowing machine of FIG. 1, shown in a second or extended orientation.

Referring now to FIGS. 2 and 9, the dynamic rowing machine 10 is illustrated in an initial, or resting, orientation. In the initial resting orientation, the first follower axle 184 is positioned in the first end arcuate segments 174 of the first lift profiles 168*a*, 168*b* and the second follower axle 186 is positioned in the first end arcuate segments 174 of the second lift profiles 170*a*, 170*b*. Referring now to FIG. 10, the dynamic rowing machine 10 is shown in a second, extended orientation. In the second extended orientation, the first follower axle 184 has been guided by the paths 180 of the first and second lifting profiles 168*a*, 168*b*, 170*a*, 170*b* and is positioned in the second end arcuate segments 178 of the first lift profiles 168*a*, 168*b* and the second follower axle 186 is positioned in the second end arcuate segments 178 of the second lift profiles 170*a*, 170*b*. During the movement of the dynamic framework 12 from the first resting orientation to the second extended orientation, the dynamic framework 12 has been guided by the first and second follower axles 184, 186 moving within paths 180 of the first and second lifting profiles 168*a*, 168*b*, 170*a* and 170*b*, thereby moving the dynamic framework 12 in simultaneous vertically rising and rearward directions.

Referring now to the embodiment shown in FIG. 9, the first lifting profile 168*a* is illustrated. The first lifting profile 168*a* includes the path 180 formed in the first frame element 160*a*. In certain embodiments, the path 180 can be lined with a low-friction liner 190. The low-friction liner 190 is configured to facilitate movement of the first and second follower axles 184, 186 along the path 180. In the illustrated embodiment, the low-friction liner 190 is formed from suitable polymeric material, such as the non-limiting examples of polyethylene, polydicyclopentadiene, Delrin®, acetal, Vespel® and the like. While the low-friction liner 190 is shown in FIG. 9 as covering the entirety of the path 180, it should be appreciated that in other embodiments, the low-friction liner 190 can be limited to certain portions of the path 180.

Figure 11:
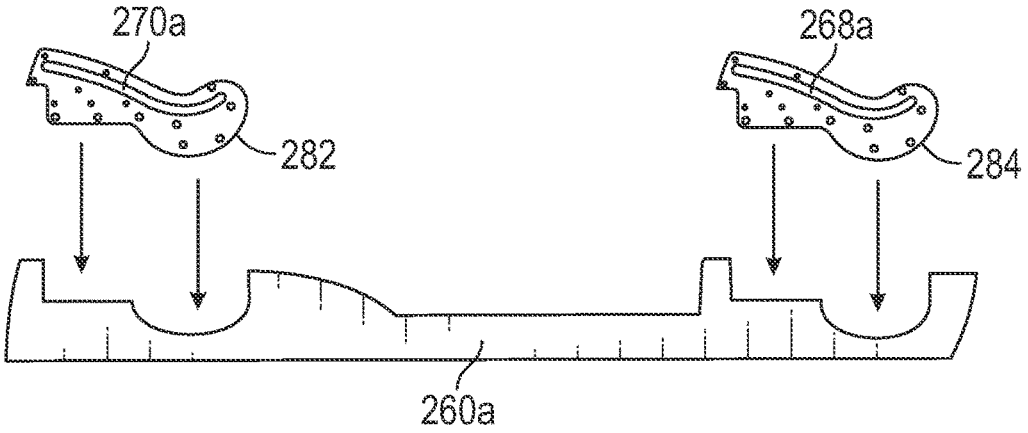
FIG. 11 is a side view of a second embodiment of a portion of the dynamic rowing machine of FIG. 1, shown in an exploded orientation.
Figure 12:
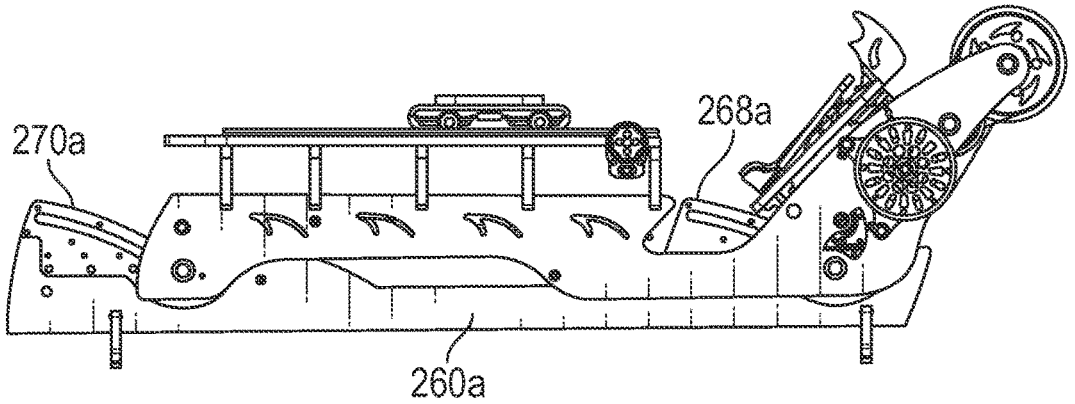
FIG. 12 is a side view of the second embodiment of the dynamic rowing machine of FIG. 11, shown in an assembled orientation.

While the dynamic rowing machine 10 is described above a forming first and second lifting profiles 168*a*, 168*b*, 170*a*, 170*b* within the first and second frame element 160*a*, 160*b*, it is contemplated that in other embodiments, the lifting profiles can be formed as distinct assemblies and attached to the first and second frame element 160*a*, 160*b*. Referring now to FIGS. 11 and 12, a first lifting profile assembly 282 and a second lifting profile assembly 284 are illustrated. The lifting assemblies 282, 284 are distinct assemblies from each other and distinct assemblies apart from the first frame element 260*a*. The lifting assemblies 282, 284 form lifting profiles 268*a*, 270*a*. In the illustrated embodiment, the lifting profiles 268*a*, 270*a* are the same as, or similar to, the lifting profiles 168*a*, 170*a* described above and shown in FIG. 8. It should be appreciated, however, in other embodiments, the lifting profiles 268*a*, 270*a* can be different from the lifting profiles 168*a*, 170*a*.

Referring again to FIGS. 11 and 12, the first and second lifting profile assemblies 268*a*, 270*a* can be formed from the same low-friction material used to form the low-friction liner 190, as described above. The first and second lifting profile assemblies 268*a*, 270*a* are attached to the first frame element 260*a* with hardware (not shown for purposes of clarity). FIG. 12 shows the first and second lifting profile assemblies 268*a*, 270*a* in an installed orientation.

In accordance with the provisions of the patent statutes, the principle and mode of the dynamic rowing machine have been explained and illustrated in certain embodiments. However, it must be understood that the dynamic rowing machine may be practiced otherwise than as specifically explained and illustrated without departing from its spirit or scope.

What is claimed is:

1. A dynamic rowing machine configured to simulate a motion of a rower working through a rowing motion of a rowing scull, the dynamic rowing machine comprising:

a stationary framework having one or more lifting profiles, each of the one or more lifting profiles having a form of a slot and comprising one or more segments forming a rising path and one or more segments forming a horizontally rearward path, the one or more segments forming the rising path and the one or more segments forming the horizontally rearward path forming a continuous path being curvilinear; and a dynamic framework supported for movement along the continuous paths of the one or more lifting profiles of the stationary framework;

wherein movement of the dynamic framework along the continuous paths of the one or more lifting profiles of the stationary framework results in upward and rearward movement of the dynamic framework.

2. The dynamic rowing machine of claim 1, wherein the stationary framework comprises a first end and a second end, and wherein a first lifting profile of the one or more lifting profiles is located at the first end and a second lifting profile of the one or more lifting profiles is located at the second end.

3. The dynamic rowing machine of claim 2, wherein dynamic framework includes a first follower axle configured to engage the first lifting profile and a second follower axle configured to engage the second lifting profile.

4. The dynamic rowing machine of claim 2, wherein the continuous path of the first lifting profile is identical to the continuous path of the second lifting profile.

5. The dynamic rowing machine of claim 1, wherein a low-friction liner is configured to line portions of the continuous paths.

6. The dynamic rowing machine of claim 1, wherein the continuous paths are formed within the stationary framework.

7. The dynamic rowing machine of claim 1, wherein the one or more lifting profiles are formed as distinct assemblies and attached to the stationary framework.

8. The dynamic rowing machine of claim 1, wherein a pulley assembly having one or more eddy brake assemblies forms a portion of the dynamic framework.

9. The dynamic rowing machine of claim 8, wherein the one or more eddy brake assemblies are configured to provide resistance as the dynamic framework moves along the continuous path.

10. The dynamic rowing machine of claim 9, wherein the pulley assembly includes a flywheel configured to provide initial and steady resistance until the one or more eddy brake assemblies gain rotational speed.

11. A method of forming a dynamic rowing machine configured to simulate a motion of a rower working through a rowing motion of a rowing scull, the method comprising the steps of:

incorporating one or more lifting profiles into a stationary framework, each of the one or more lifting profiles having a form of a slot and comprising one or more segments forming a rising path and one or more segments forming a horizontally rearward path, the one or more segments forming the rising path and the one or more segments forming the horizontally rearward path forming a continuous path being curvilinear;

supporting a dynamic framework for movement along the continuous paths of the one or more lifting profiles of the stationary framework;

wherein movement of the dynamic framework along the continuous paths of the one or more lifting profiles of the stationary framework results in upward and rearward movement of the dynamic framework.

12. The method of claim 11, including the steps of positioning a first lifting profile of the one or more lifting profiles at a first end of the stationary framework and a second lifting profile of the one or more lifting profiles at a second end of the stationary framework.

13. The method of claim 12, including the steps of engaging the first lifting profile with a first follower axle and engaging the second lifting profile with a second follower axle.

14. The method of claim 12, including the step of forming the continuous path of the first lifting profile to have an identical path as the continuous path of the second lifting profile.

15. The method of claim 11, including the step of lining portions of the continuous paths with a low-friction liner.

16. The method of claim 11, including the step of forming continuous paths within the stationary framework.

17. The method of claim 11, including the steps of forming the one or more lifting profiles as distinct assemblies and attaching the distinct assemblies to the stationary framework.

18. The method of claim 11, including the step of forming a pulley assembly having one or more eddy brake assemblies as a portion of the dynamic framework.

19. The method of claim 18, including the step of providing resistance with the one or more eddy brake assemblies as the dynamic framework moves along the continuous path.

20. The method of claim 19, including the step of providing initial and steady resistance to movement of the dynamic framework with a flywheel until the one or more eddy brake assemblies gain rotational speed.

* * * * *